US009831591B2

(12) United States Patent
Hu

(10) Patent No.: US 9,831,591 B2
(45) Date of Patent: Nov. 28, 2017

(54) CATCH ELEMENT OF A CONTACT HAVING A NOSE-SHAPED PROJECTION

(71) Applicant: Robert Bosch GmbH, Stuttgart (DE)

(72) Inventor: Zhenyu Hu, Leonberg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/345,989

(22) Filed: Nov. 8, 2016

(65) Prior Publication Data

US 2017/0133783 A1 May 11, 2017

(30) Foreign Application Priority Data

Nov. 9, 2015 (DE) ..... 10 2015 221 937

(51) Int. Cl.
*H01R 13/432* (2006.01)

(52) U.S. Cl.
CPC ..... *H01R 13/432* (2013.01)

(58) Field of Classification Search
CPC ... H01R 13/432; H01R 13/111; H01R 13/113; H01R 13/114; H01R 13/187
USPC ..... 439/746, 850, 851, 852
See application file for complete search history.

(56) References Cited

U.S. PATENT DOCUMENTS 5,911,603 A * 6/1999 Mansutti ..... H01R 13/111 439/748
6,019,646 A * 2/2000 Okamura ..... H01R 13/113 439/748
6,361,377 B1 * 3/2002 Saka ..... H01R 13/7032 439/745
6,994,596 B2 * 2/2006 Katsuma ..... H01R 13/432 439/746
7,014,515 B2 * 3/2006 Lutsch ..... H01R 13/113 439/843
7,938,699 B2 * 5/2011 Okano ..... H01R 4/185 439/877
8,323,061 B2 * 12/2012 Hori ..... H01R 13/114 439/852

(Continued)

FOREIGN PATENT DOCUMENTS

DE 8608199 U1 5/1986
DE 102009054705 A1 6/2011
DE 102014216864 A1 2/2016

*Primary Examiner* — Harshad Patel
(74) *Attorney, Agent, or Firm* — Norton Rose Fulbright US LLP; Gerard Messina

(57) ABSTRACT

An electrical contact for plugging into a contact cavity of a plug-in connector. The electrical contact includes an elongated housing extending in the plug-in direction, and an elongated catch element for latching the contact in the contact cavity. The catch element is fixed in place on the housing by a first end. By a first section, the catch element elastically and obliquely projects from the housing in an outward direction, counter to the plug-in direction, and transitions from a second, self-supporting end of the catch element to a second section of the catch element, which is bent inwardly in the direction of the housing. The second section has a rear-side area whose surface normal extends essentially counter to the plug-in direction. A projection is situated on the rear-side area projecting from the rear-side area beyond a maximum longitudinal extension of the rear-side area, when viewed counter to the plug-in direction.

13 Claims, 3 Drawing Sheets

(56) References Cited

U.S. PATENT DOCUMENTS

| | | | | |
|---|---|---|---|---|
| 2005/0085139 | A1* | 4/2005 | Copper | H01R 13/057<br>439/852 |
| 2012/0094550 | A1* | 4/2012 | Itou | H01R 13/113<br>439/867 |
| 2013/0040506 | A1* | 2/2013 | Pade | H01R 13/432<br>439/748 |
| 2014/0051289 | A1* | 2/2014 | Aoki | H01R 13/428<br>439/607.01 |
| 2014/0051307 | A1* | 2/2014 | Aoki | H01R 13/432<br>439/746 |
| 2015/0340792 | A1* | 11/2015 | Hu | H01R 13/428<br>439/660 |

* cited by examiner

CATCH ELEMENT OF A CONTACT HAVING A NOSE-SHAPED PROJECTION

CROSS REFERENCE

The present application claims the benefit under 35 U.S.C. §119 of German Patent Application No. DE 102015221937.2 filed on Nov. 9, 2015, which is expressly incorporated herein by reference in its entirety.

FIELD

The present invention relates to an electrical contact for establishing an electrical connection. More specifically, the present invention relates to an electrical contact to be plugged into a contact cavity of a plug-in connector.

BACKGROUND INFORMATION

In vehicle manufacturing, for instance, it is often necessary to interconnect electrical lines. For example, electrical cables can be connected to one another. Frequently used for this purpose are plug-in connectors, such as in the form of plugs and plug sockets, in which a contact cavity or a plurality of contact cavities is/are provided inside a plug housing. A contact, connected to a respective electrical line, is situated in each contact cavity and locked therein. The contact is designed to establish an electrically conductive connection with a correspondingly developed mating contact of a counterplug or a socket connector once the plug has been plugged into the counterplug or the plug socket.

During the production of such plugs, the contacts, onto whose rear end the associated cables may be crimped, are inserted into the individual contact cavities. To prevent the contacts from slipping out of the contact cavities when pulling on the cables, for instance, the contacts are often locked in the contact cavities in a form-locking manner. In one frequently used development of the contacts, an outwardly projecting and inwardly deflectable catch element, such as a primary catch arm, is provided on the housing of the contact for this purpose. This primary catch arm projects obliquely outwardly beyond the housing of the contact, counter to a plug-in direction in which the contact is inserted into the contact cavity when the plug connector is assembled. When sliding the contact into the contact cavity, the primary catch arm is first elastically deformed in the inward direction, in order to then allow it to rebound into a recess in the contact cavity once it has reached its target position, to thereby latch the contact inside the contact cavity. In German Patent Application No. DE 10 2009 054705 A1, an electrical contact is described for plug-in connectors having a primary catch arm that projects outwardly and is inwardly deflectable.

Increasingly higher mechanical demands are placed on plug-in connectors and the contacts used therein, especially when they are intended for use in motor vehicles. On the one hand, for the uncomplicated assembly of the contacts in the contact cavities, the primary catch arm should be able to be elastically compressed with as little force as possible and then return to its initial position in order to allow a contact to be latched inside a contact cavity in a simple and reliable manner. On the other, the latching of the contacts inside the contact cavities of the plug should be as reliable and secure as possible so as to prevent an unintentional pullout of contacts, for instance when pulling on the cables crimped onto the contacts. Especially in the case of miniaturized contacts, on which high mechanical demands are placed despite a small size and low material thicknesses, it may be difficult to satisfy these contradictory demands.

SUMMARY

Specific embodiments of the present invention may advantageously allow the contact to absorb a higher pullout force without the contact or a catch element of the contact being damaged or deformed. This makes it possible to achieve greater mechanical stability and improved electrical reliability of the contact and the plug-in connector. Ideas in connection with specific embodiments of the present invention may be deemed to be based on the thoughts and recognitions described in the following text, among other things:

When pulling on the inserted contact, for instance by pulling on a line crimped onto a contact, the contact is subjected to a pullout force that acts counter to a plug-in direction of the contact into the contact cavity. In the latched state of the contact, in a convention manner, the catch element or the primary catch arm is pressed against a sidewall that runs transversely to the plug-in direction, or against an undercut or a rear wall of the contact cavity, which inhibits a further outward movement of the contact. Because of the catch element that projects obliquely from the housing in the latched state, a portion of the pullout force is acting on the end of the catch element that is resting against the sidewall of the contact cavity, in a direction transverse to the plug-in direction. Particularly in the case of high pullout forces, this force component may become so great that the free end of the catch element slides away from the housing along the sidewall, and therefore leads to a more pronounced deflection of the catch element away from the housing. Because of the spring-back of the catch arm, the lever arm in relation to the root of the catch element on the housing continues to increase. Even at a constant force, this may result in an increase in the particular torque that is acting on the root of the catch element. This may lead to overloading of the root, which can result in an undesired plastic deformation of the catch arm or even to the breaking of the catch arm. The root is situated on the particular end of the catch element that is connected to the housing. For instance, the root may be an end of the catch element that lies opposite from the free end of the catch element. Therefore, it may be desirable to prevent the catch element from sliding away from the housing, if possible, or at least to make it more difficult.

According to a first aspect of the present invention, an electrical contact for plugging into a contact cavity of a plug-in connector is therefore proposed. The contact has an elongated housing that extends in the plug-in direction as well as an elongated catch element for latching the contact into place in a contact carrier or in an undercut or a recess of a contact cavity, it being possible that the contact cavity is situated inside a contact carrier. The catch element is fastened to the housing by a first end. By a first section, the catch element projects obliquely and elastically from the housing in an outward direction, counter to the plug-in direction, and transitions from a second, self-supporting end of the catch element to a second section of the catch element which is bent inwardly in the direction of the housing. The second section has a rear-side area whose surface normal essentially extends counter to the plug-in direction. Situated on the rear-side area is a projection which, especially when viewed counter to the plug-in direction, projects from the rear-side area beyond a maximum longitudinal extension of the rear-side area.

One particular advantage may be seen in the fact that a reinforced, form-locking mechanical contact is established between the catch element and the sidewall of the contact cavity. This makes it possible to retain the catch element in its position even at an increasing pullout force. The pullout force is thereby able to be absorbed by the contact without any, or only minimal, deformation of the catch element, and the contact thus is able to resist even stronger pullout forces more effectively.

The reason for this is that the projection comes into mechanical contact with the sidewall when the contact is pulled out of the contact cavity. Since the pressure is physically given by the expression force per area (p=F/A), the projection with a small contact area in comparison to the relatively large area of the second section (without projection) generates a high pointwise or line-shaped pressure on the undercut or the sidewall of the contact cavity according to the above relation. Thus, the projection is able to bury itself into the sidewall or into the undercut in the way of a crampon, or to increase the friction, thereby also creating a form-locking connection between the projection, and thus the catch element, and the sidewall or the undercut. This counteracts slipping of the catch element away from the housing, i.e., toward the outside, in an advantageous manner.

The catch element is designed to allow movement. This means it can be reversibly moved from a first position, in which the catch element projects and the contact is in the latched state, to a second position. The second position is at hand when the catch element is pressed inward toward the housing, for instance when the contact is inserted into the contact cavity. A housing, for example, may be an elongated hollow body made from sheet metal, whose dimensions are suitable for insertion into a contact cavity, and which has adequate mechanical stability. The catch element may likewise be made from sheet metal and connected to the housing in an integral fashion. "Toward the outside" here means a direction that points away from the housing, transversely or perpendicularly to the plug-in direction or insertion direction. Conversely, "inward" means a direction toward the housing. During the insertion process of the contact into the contact cavity, the catch element, for instance, is initially deflected inwardly and then elastically springs back outwardly into the first setting or the first position in the final position. In one example, the second section may also be fixed in place on the first section, thereby creating the bent-over development.

The projection is developed and situated in such a way that when the contact is moved outwardly counter to the plug-in direction of the contact, the projection first makes contact with the sidewall of the contact cavity in the plugged-in state. Due to the form of the projection, a pullout force is thus concentrated on a smaller area on the sidewall of the contact cavity and depending on the material of the sidewall, may form a local depression which, on account of its geometrical form and the changed force distribution that results therefrom, generates a greater resistance to a movement of the catch element in a direction away from the housing. In other words, a friction between catch element and sidewall of the contact cavity therefore becomes greater and thus advantageously makes it more difficult for the catch element, in particular the projection of the second section, to slide away. With regard to the surface normal of the rear-side area, "essentially" means that the surface normal defines an angle of 90 degrees plus/minus 40 degrees with a longitudinal axis of the housing, and of 90 degrees plus/minus 20 degrees in one example. A possible angular range must be restricted in such a way that it is ensured that in the plugged-in state, the projection first makes contact with the sidewall in an outward movement.

In one specific embodiment, the projection is developed in the shape of a nose or wedge. This means that the projection has two areas that run from the rear-side area toward an end of the projection; in case of a nose-like shape, the areas have one longer and one shorter edge in cross-section, which extend approximately extend in the longitudinal direction of the housing. In the case of a wedge shape, the areas have two edges of approximately the same length. The advantage of a nose shape may be an increased mechanical stability since the projection is able to absorb greater forces in a direction away from the housing, provided that the edge disposed in the longitudinal direction extends farther outside than the other edge or area. In other words, this design describes a nose shape that is rotated by 180 degrees, starting from the housing. Advantages of a wedge shape may be a concentration of the pullout force on a clearly smaller area and thus, more effective burying of the projection in the sidewall. Because of the nose shape or the wedge shape, the pressure on the sidewall, and thus the "crampon effect", is able to be increased further in an advantageous manner, for instance by a defined edge on the end of the projection (the nose end or the wedge end) that is facing the sidewall or the undercut.

In one specific embodiment, the projection has a first area including a projecting-part end that points away from the rear-side area. In addition, the projection has a second area that adjoins the first area, the center of area of the first area lying farther outside in a transverse direction perpendicular to the plug-in direction, or in other words, at a greater distance from the housing, than the center of area of the second area. The first area thus is situated farther away from the housing than the second area (with regard to the center of area). The first area is outwardly directed in relation to the housing, in particular with its surface normal. The second area essentially extends between the projecting-part end and the rear-side area of the second section. In other words, the first area extends from the rear-side area toward the projecting-part end, basically counter to the plug-in direction at first, and from there then extends obliquely with a second area in the inward direction, back to the rear-side area; this applies particularly to the first setting or the first position of the catch element. "Inward" is meant to denote that this point lies closer to the housing than a point farther away on the outside. In an outward movement, the projecting-part end first establishes mechanical contact with the sidewall of the contact cavity.

One advantage of this specific development may be that an effective concentration of the force acting on the sidewall and an advantageous force distribution and, depending on the material of the sidewall, an increase in the friction between the catch element and the sidewall is able to be achieved. This may allow for the absorption of greater pullout forces. A center of area is a geometrical centroid or a center point of an area, that is to say, a defined point that may be considered the center point of an area.

In one specific embodiment, the first area essentially extends parallel to the plug-in connection. "Essentially" parallel in this case is meant to describe an exact parallel position having a possible deviation of plus/minus 15 degrees. The advantage here may be that in the establishment of mechanical contact under the action of a force (e.g., a force of at least 1N at the contact counter to the plug-in direction) of the projection with the sidewall or the undercut, a depression or an indentation forms in the sidewall or in the undercut that is able to absorb greater forces in a direction away from the housing.

According to one specific embodiment, the first area and the second area define a first angle α, first angle α lying in a range between 40° and 80°, and in particular in a range between 45° and 70°. An excellent compromise between mechanical stability of the projection and a sufficient force concentration and friction increase for an effective pullout protection may be considered an advantage. If one assumes an extension parallel to the longitudinal extension and if the second section is approximately perpendicular to the plug-in direction of the contact in the first position or in the first setting of the catch element, then it follows that first angle α must be smaller than 90 degrees in order to enable a return of the second area to the rear-side area. Similarly, at an inclination of the first area relative to the plug-in direction of minus 15 degrees, still to be described as essentially parallel (i.e. an inclination of the first area toward the housing), first angle α of 105 degrees, and at an inclination of plus 15 degrees (i.e. an inclination of the first area away from the housing), first angle α of 75 degrees would not be achieved to allow a function according to the present invention.

In one specific embodiment, the first area extends obliquely outwards away from the housing, starting from the second section of the catch element, and defines a second angle β of 5 to 20 degrees with respect to the plug-in direction. In other words, this arrangement results in a hook effect, which may allow an even better force absorption and friction increase in a direction away from the housing. For example, the result may be a depression that extends obliquely into the sidewall or the undercut or a rear wall of a recess of the contact cavity for the latching of the catch element, this depression being able to absorb the applied force more effectively and in a manner that is mechanically more stable, in particular in an outward direction. This may provide even more effective protection against the pullout of the contact or against overstretching of the catch arm in an outward direction.

According to one specific embodiment, the second section of the catch element has a first width and the second area of the projection has a second width, the second width corresponding to between 40% and 60% of the first width. The width of the second section or the second area may be understood as the extension of the second section or the second area perpendicular to a snap-in direction of the catch element in the direction of the housing (i.e., inwardly) and perpendicular to the plug-in direction. This further reduces the area that first comes into contact with the sidewall or the undercut, thereby causing a further increase in the pressure on the contact point between projection and sidewall at a constant pullout force. Another advantage of this specific embodiment may be a sufficiently good concentration of the pullout force component given an advantageous geometrical design, so that a sealing mat, for example, through which the contact must be inserted during the assembly or disassembly process, will not be damaged. In other words, the development of the projection is not too pointed or angular, so that the sealing mat does not sustain damage when the contact rubs against the sealing mat.

According to one specific embodiment, the housing of the contact is developed from a sheet metal, the projection being pressed out of the second section of the catch element. A simpler production of the contact, including the projection, may be considered an advantage. The contact may be a stamped and bent part, in particular, and/or be produced in one piece.

In one specific embodiment, the contact is a miniaturized contact, and the housing has a sheet metal having a thickness of less than 0.5 millimeters. The advantageous effects of the contact according to the present invention may be found particularly in miniaturized contacts since they require very low material thicknesses and dimensions on the one hand, but must satisfy high mechanical demands on the other. At the same time, it comes as a surprise that a projection is able to be formed in a defined manner using such low sheet metal thicknesses and to thereby increase a stability of the catch element.

In one aspect of the present invention, a plug-in connector is provided which includes a contact as well as a contact carrier having a contact cavity for the accommodation of the contact. The catch element is designed to project at least partially into a recess of the contact cavity of the contact carrier by its first and second section in the latched state of the contact, in such a way that the second section of the catch element is able to make contact with a sidewall of the recess when the contact moves counter to the plug-in direction, thereby inhibiting a further movement of the contact out of the contact cavity. In other words, when the contact is pulled out, the catch element strikes the sidewall in the contact cavity, i.e. an undercut in the contact cavity, for instance, and mechanically retains the contact in the contact cavity.

In the latched position, the catch element is in the first position. The mechanical contact with the sidewall of the contact cavity, for example, may come about only when the contact is moved out of the contact cavity, for instance when pulling on the connected cable. In the normal plugged-in state, there may be a gap between the second section of the catch element and the sidewall due to tolerance-related reasons, among other things.

In one specific embodiment of the present invention, an elasticity of the material of the projection is lower than an elasticity of a material of the sidewall of the contact cavity, so that when the contact is pulled out of the contact carrier or out of the contact cavity and the catch element is consequently pressed against this sidewall or against the undercut, the projection creates a depression in the sidewall in the undercut, so that the depression inhibits a movement of the second section of the catch element in the direction away from the housing of the contact. For instance, the material of the contact cavity, and thus also of the sidewall, may include plastic and the material of the projection may include a metal, for instance.

The elasticity may be synonymous with the hardness of the material here. The following relation then applies in this context: a higher elasticity corresponds to a lower hardness of the material. The material of the contact cavity may be a soft material, in particular, and the material of the projection or the catch element or even the entire electrical contact may be a harder material in comparison. A depression describes a cavity or recess, spatially situated in the region of the projecting-part end, in comparison with a surrounding surface of the sidewall. This depression causes the formation of area sections of the depression whose surface normals are directed obliquely outward, away from the housing, which thereby creates increased friction for the projecting-part end in a direction away from the housing, so that, in other words, the projection with the catch element is unable to slide away as quickly.

In one specific embodiment, starting from the second section of the catch element, the first area of the projection extends obliquely outward and away from the housing, in such a way that the resulting depression in the sidewall of the cavity is also directed obliquely outwards. In other words, the first area defines an angle of more than 0 degrees and up to 15 degrees vis-à-vis the longitudinal extension of the housing, so that a hook-like form of the projection results. In this way, the pullout force component in a direction away from the housing (i.e., toward the outside) is advantageously able to be introduced more effectively into the sidewall of the contact cavity, away from the housing (i.e., toward the outside), which in turn may increase a maximum pullout force. Because of a non-perpendicular force vector on the sidewall that results therefrom, the form of the depression also has a greater degree of depression, indentation or burying in a direction away from the housing, i.e., toward the outside.

It is pointed out that some of the possible features and advantages of the contact and the plug-in connector have been described in this text with reference to different specific embodiments. One skilled in the art recognizes that the features can be suitably combined, adapted or exchanged in order to obtain further specific embodiments of the present invention.

BRIEF DESCRIPTION OF THE DRAWINGS

In the following text, specific embodiments of the present invention are described with reference to the figures; neither the figures nor the description are/is to be interpreted as limiting the present invention.

The figures are merely schematic and not true to scale. Identical reference numerals in the figures denote identical or identically acting features.

DETAILED DESCRIPTION OF EXAMPLE EMBODIMENTS

Figure 1:
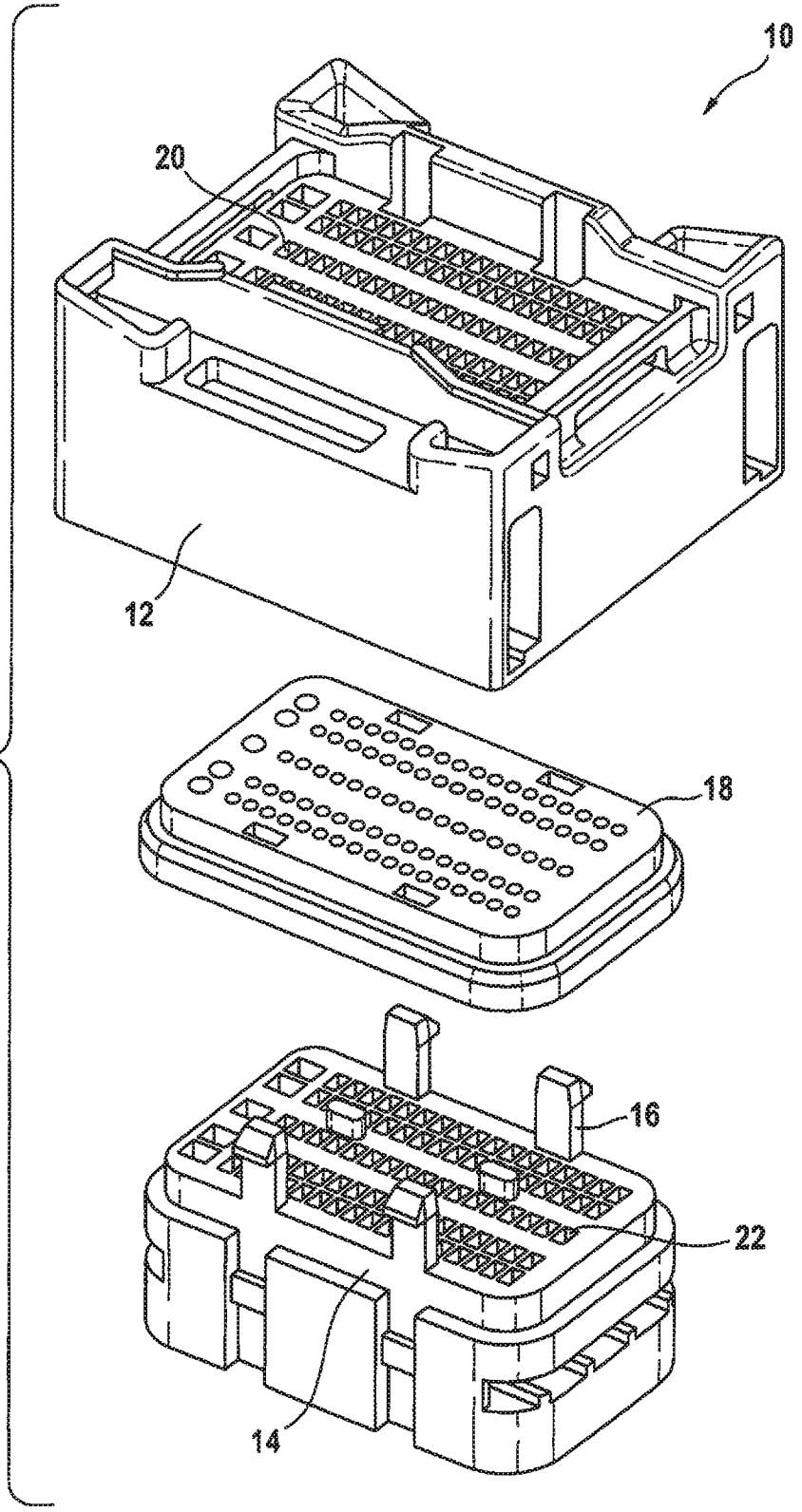
FIG. 1 shows a plug of a plug-in connector in an exploded view.

FIG. 1 shows one example of a plug 10 of a plug-in connector, which may be mechanically and electrically configured for being combined with a corresponding counterplug (not shown). Plug 10, for example, may be used for the mechanical and electrical connection of a plurality of cables to one another or of a cable tree to a control unit in a motor vehicle. Plug 10 has an upper housing part 12 and a lower housing part 14, which are able to be mechanically connected to each other via catch tabs 16. A sealing mat 18 is situated between upper housing part 12 and lower housing part 14. Through-feeds 20 for the mechanical stabilization of the respective electrical line are provided in upper housing part 12, and the associated contact cavities 22 are provided in lower housing part 14. The cables and the contacts fixed in place on their ends (not shown here) are introduced through through-feeds 20 in upper housing part 12 and through sealing mat 18 into lower housing part 14 and fixed in place by latching inside contact cavities 22. Sealing mats 18, for example, may be developed on a silicon basis and therefore include soft materials.

Figure 2:
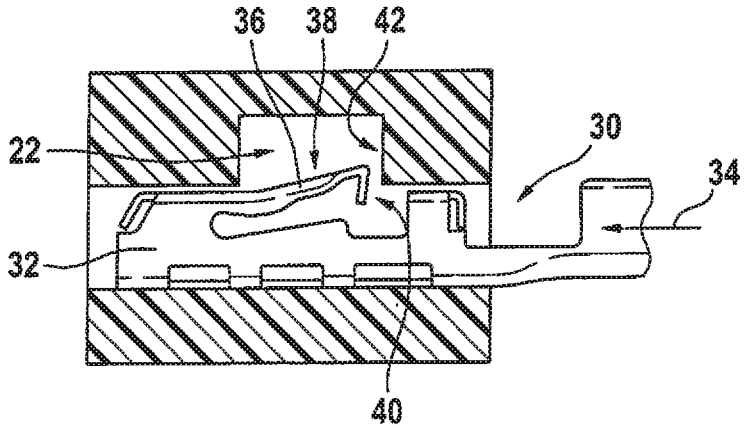
FIG. 2 shows a cross-sectional view of a contact inside a contact cavity that is closed in the upward direction.

FIG. 2 shows an example of a contact 30, which is inserted into a contact cavity 22, the latter including an undercut or a recess (on top in the figure). The contact has an elongated housing 32, which extends in a plug-in direction 34. An elongated catch element 36 projects obliquely from housing 32 in the outward direction. This catch element 36 may be latched into place in the recess or on the undercut of contact cavity 22. For better readability, the text often refers only to latching in contact cavity 22.

In the example illustrated here, contact cavity 22 is developed in closed form, which means that only limited space is available for a possible deflection of catch element 36. With a first section 38, catch element 36 flexibly and outwardly projects from housing 32 in an oblique manner, counter to plug-in direction 34, and then transitions into a second section 40 which is bent inward in the direction of housing 32. If a pullout force (for instance of more than 0.5N or more than 1N) is now exerted on contact 30 counter to plug-in direction 34, then contact 30 moves in a direction counter to plug-in direction 34. A further movement of contact 30 out of contact cavity 22 is now inhibited due to catch element 36 being pressed against a sidewall 42 of contact cavity 22 by its second section 40. For instance, catch element 36 may have a flexurally stiff design for this purpose, in order to be able to absorb the highest pullout forces possible without causing bending of catch element 36. Because of the oblique protrusion of catch element 36 from housing 32, a pullout force impinges on sidewall 42 of contact cavity 22 in an oblique manner.

Figure 3:
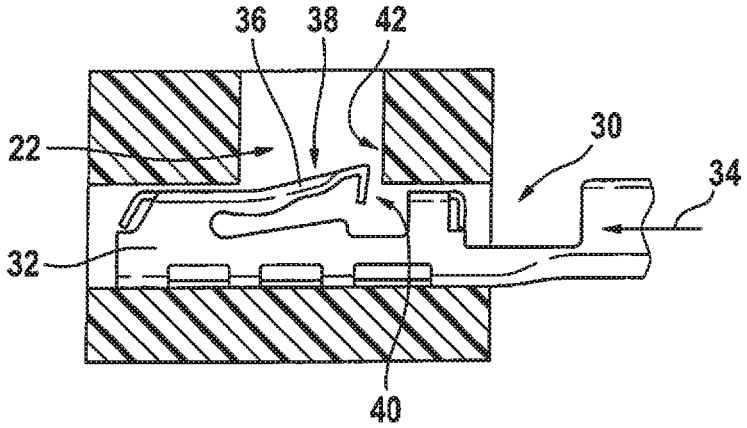
FIG. 3 shows a cross-sectional view of a contact inside a contact cavity that is open in the upward direction.

FIG. 3 also shows a contact 30, which is inserted into a contact cavity 22. However, in the example shown here, contact cavity 22 is developed as an upwardly open cavity; without a stop in the upward direction, there is the risk here, like in FIG. 3, that during an outward movement (i.e., in the upward direction in this instance), the catch element slides more and more toward the outside (that is to say, in the upward direction in the figure) as a result of a pullout force on the electrical contact, and that this movement is even increased further because of the steadily growing lever arm and the thereby steadily increasing torque. If a defined (angular) position of the catch element is exceeded by this movement, then it may happen that the catch element is plastically deformed at the root or breaks, or that the catch element will be damaged in some other way and loses its spring elasticity, in particular. All other elements basically correspond to those in FIG. 2. Depending on the intended use and the use scenario, both open and closed variants of contact cavities 22 may be employed.

Figure 4:
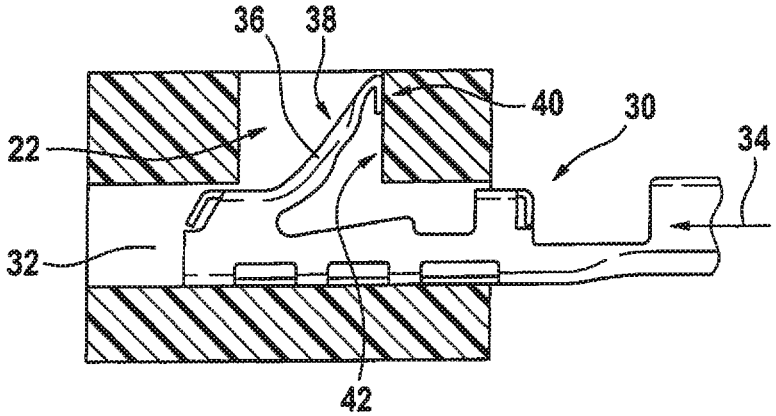
FIG. 4 shows a theoretical placement of a catch element of a contact in a sub-region of the contact cavity when a maximum pullout force is exceeded.

In FIG. 4, a development of a conventional contact 30 is simulated and shown, on which a pullout force is acting that exceeds a permitted maximum value. Housing 32 of the contact moves counter to plug-in direction 34. Because of the oblique protrusion of catch element 36 from housing 32 and the likewise oblique impinging of the pullout force on sidewall 42 caused thereby, a force component results on the end of first section 38 and on second section 40 that is directed transversely to plug-in direction 34 and away from housing 32. It may have the effect that an existing friction between second section 40 and sidewall 42 is overcome and catch element 36, in particular with its second section 40, is displaced or slides outwardly along sidewall 42. This effect may lead to strong bending, for instance in the region of the transition between housing 32 and catch element 36 (i.e., the root), which could possibly result in damage to catch element 36 or contact 30. Undesired bending effects in the region of the transition between first section 38 and second section 40 of catch element 36 are possible in addition.

Figure 5:
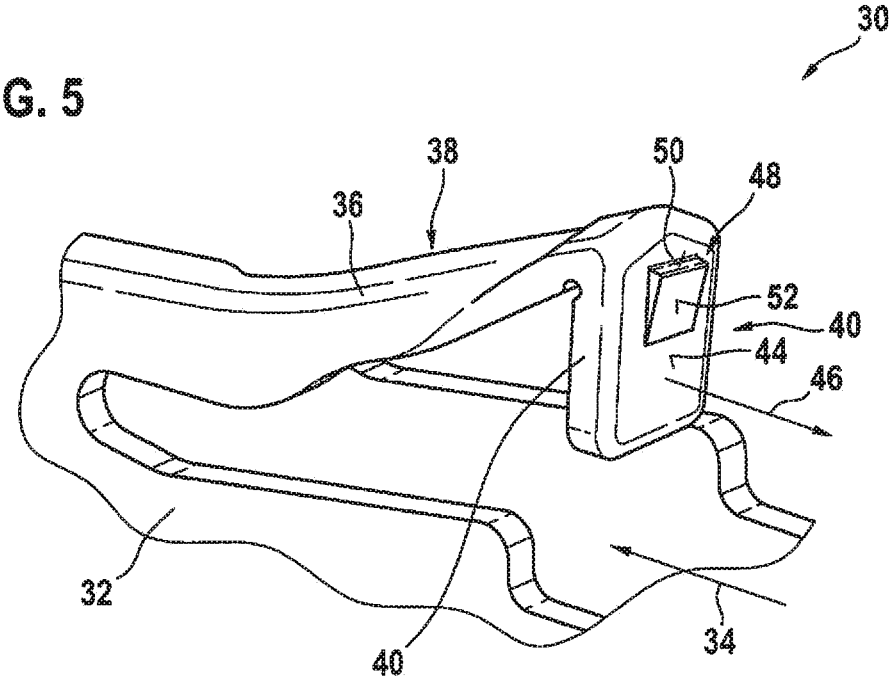
FIG. 5 shows a three-dimensional view of a sub-region of a catch element of a contact according to the present invention having a projection on the second section.

FIG. 5 shows a sub-region of a contact 30 according to the present invention including a catch element 36, a first section 38 and a second section 40 in a three-dimensional view. Second section 40 has a rear-side area 44, whose surface normal 46 extends essentially counter to plug-in direction 34. A projection 48 is situated on rear-side area 44.

This projection 48 protrudes from rear-side area 44 counter to plug-in direction 34 beyond a maximum longitudinal extension of rear-side area 44. In other words, when contact 30 is moved out of contact cavity 22, projection 48 would first come into mechanical contact with sidewall 42 of contact cavity 22. In the case illustrated in this figure, projection 48 has a first area 50 on the upper side (i.e., on the side facing away from housing 32) and a second area 52 in a direction counter to plug-in direction 34. First area 50 defines a first angle $\alpha$ together with second area 52 (see FIG. 6 in this context: first angle $\alpha$ is plotted between the continuation, drawn in dashed form, of first area 50 and second area 52). This first angle $\alpha$ may preferably lie in a range of 40° to 80°, and preferably in the range of 45° to 70°. Furthermore, in the first setting or position of catch element 36, first area 50 defines a second angle $\beta$ with plug-in direction 34 (see FIG. 6). This second angle $\beta$ may either amount to approximately 0° (0°+/−3°), which is the case here. In the first position of catch element 36, first area 50 is then approximately parallel with plug-in direction 34. To create a projection 48 developed in the shape of a hook, first area 50 may also protrude obliquely upward or outward counter to the plug-in direction, starting from second section 44. For this purpose, second angle $\beta$ may lie in a range of 5° to 40°, for example, and preferably lies in a range of 5° to 20°.

It can be seen clearly that the center of area of first area 50 lies above the center of area of second area 52, or in other words, further outside or farther away from housing 32. In this particular case, projection 48 has the form of a nose that is standing on its head. Not shown here is a shape of the projection in which projection 48 has a wedge shape, that is to say, a form in which projection 48 has roughly the form of an isosceles triangle, for instance, the approximately equal-length sides being formed by first area 50 and second area 52.

First area 50 need not necessarily be uninterrupted but may also include recesses in one example. For instance, these recesses may be produced on account of the manufacturing process and because of a low thickness of the material that is used. Here, first area 50 extends essentially parallel to plug-in direction 34, second angle $\beta$ thus amounting to approximately 0°. In the exemplary embodiment shown here, a width of second area 52 corresponds to approximately 40 to 60 percent of the width of second section 40, viewed in a direction transversely to plug-in direction 34 and transversely to the spring-back direction of catch element 36.

Figure 6:
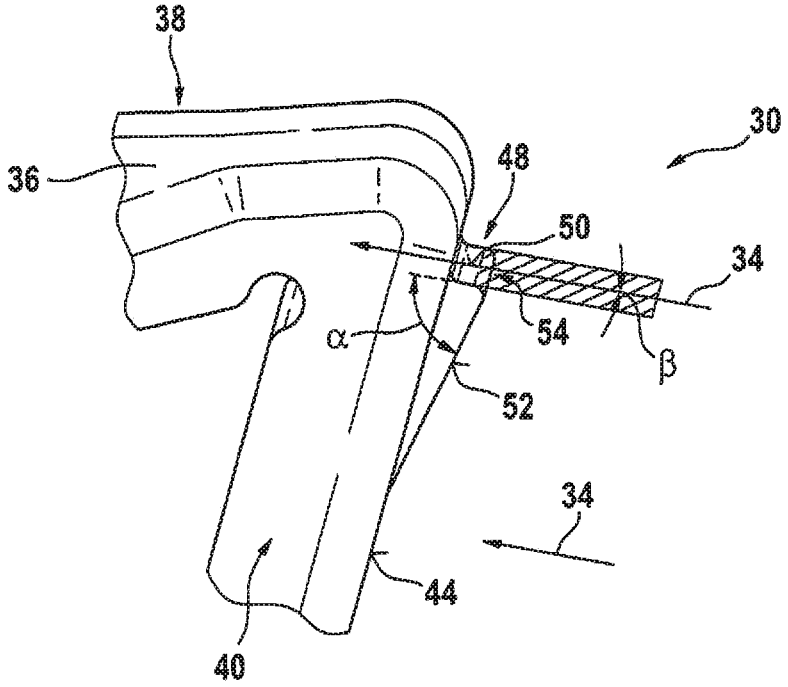
FIG. 6 shows a schematic representation of a region of the transition between a first and a second section of a catch element of a contact according to the present invention having a nose-shaped projection.

FIG. 6 shows an enlarged cut-away of contact 30 from FIG. 5. Only a sub-region of catch element 36 in the area of the transition between first section 38 and second section 40 is schematically shown in a three-dimensional view. A rear-side area 44 is situated on second section 40, on which a projection 48 is located. This projection 48 has a first area 50 that extends approximately parallel to plug-in direction 34. This can be seen quite clearly by the extension of first area 50, shown in hatched form, because here plug-in direction 34, represented by an arrow, runs in the plane of first area 50. As described for FIG. 5, first area 50 may also assume an angle other than 0°, in particular an angle of 5° to 40° with respect to plug-in direction 34.

In a transverse direction, viewed perpendicularly to the plug-in direction, the center of area of first area 50 lies farther outside than the center of area of a second area 52 that adjoins first area 50. Situated at the transition between first area 50 and second area 52 is a projecting-part end 54. When contact 30 moves out of contact cavity 22, this projecting-part end 54 first makes contact with sidewall 42 of contact cavity 22. The contact surface between projecting-part end 54 and sidewall 42 or the undercut or the wall of the recess of contact cavity 22, is decisive for the pressure that is exerted on the material of sidewall 42 at the given pullout force (formula: $p=F/A$): the smaller the area, the higher the pressure, and thus the higher the catching effect or the crampon effect or the clawing effect of projection 48 in sidewall 42 or the undercut. In one example, projection 48 is developed in the shape of a hook. This means that relative to a longitudinal extension of housing 32, projecting-part end 54 is situated at a greater distance from the housing than the attachment point of first area 50 on rear-side area 44. When projection 48 has buried itself in sidewall 42 or has created a depression or recess in sidewall 42, it is then able to thereby create a form-locking connection together with the depression or recess.

Finally, it should be mentioned that terms such as "having", "including" etc. do not exclude other elements or steps and that terms such as "one" or "a" do not exclude a plurality. For example, it is possible to provide more than one projection 48 on catch element 36. Also, more than one catch element 36 may be provided on electrical contact 30.

What is claimed is:

1. An electrical contact for plugging into a contact cavity of a plug-in connector in a plug-in direction, comprising:

an elongated housing extending in the plug-in direction; and an elongated catch element for latching the contact in the contact cavity, the catch element being fastened to the housing by a first end, and the catch element elastically and obliquely projecting from the housing by a first section counter to the plug-in direction in an outward direction, and transitioning from a second, self-supporting end of the catch element to a second section of the catch element, which is bent inwardly in a direction of the housing, wherein the second section has a rear-side area whose surface normal extends essentially counter to the plug-in direction;

wherein a projection is situated on the rear-side area, the projection projecting from the rear-side area beyond a maximum longitudinal extension of the rear-side area, when viewed counter to the plug-in direction.

2. The electrical contact as recited in claim 1, wherein the projection is in the shape of a nose or a wedge.

3. The electrical contact as recited in claim 1, wherein the projection includes a first area having a projecting-part end that faces away from the rear-side area, the projection having a second area that adjoins the first area, a center of area of the first area lying farther outside than a center of area of the second area when viewed in a transverse direction perpendicular to the plug-in direction; wherein the first area is outwardly directed in relation to the housing; wherein the second area essentially extending between the projecting-part end and the rear-side area of the second section.

4. The electrical contact as recited in claim 3, wherein the first area essentially extends parallel to the plug-in direction.

5. The electrical contact as recited in claim 3, wherein the first area and the second area define a first angle $\alpha$, the first angle $\alpha$ is in a range between 40° and 80°.

6. The electrical contact as recited in claim 5, wherein the first angle $\alpha$ is in a range between 45° and 70°.

7. The electrical contact as recited in claim 5, wherein the first area projects obliquely outward, away from the housing, starting from the second section of the catch element, and defining a second angle $\beta$ of 5 to 20 degrees with respect to the plug-in direction.

8. The electrical contact as recited in claim 3, wherein the second section of the catch element having a first width and the second area of the projection having a second width, the second width corresponding to between 40% and 60% of the first width.

9. The electrical contact as recited in claim 3, wherein the housing of the contact is made from a sheet metal, the projection being pressed out of the second section of the catch element.

10. The electrical contact as recited in claim 1, wherein the contact is a miniaturized contact, the housing including a sheet metal having a thickness of less than 0.5 millimeters.

11. An electrical plug-in connector, comprising:

an electrical contact including an elongated housing extending in a plug-in direction, and an elongated catch element for latching the contact in a contact cavity, the catch element being fastened to the housing by a first end, and the catch element elastically and obliquely projecting from the housing by a first section counter to the plug-in direction in an outward direction, and transitioning from a second, self-supporting end of the catch element to a second section of the catch element, which is bent inwardly in a direction of the housing, wherein the second section has a rear-side area whose surface normal extends essentially counter to the plug-in direction, wherein a projection is situated on the rear-side area, the projection projecting from the rear-side area beyond a maximum longitudinal extension of the rear-side area, when viewed counter to the plug-in direction; and a contact carrier having the contact cavity for the accommodation of the contact;

wherein the catch element is designed to project at least partially into a recess of the contact cavity of the contact carrier by the first and the second section in the latched state of the contact, in such a way that the second section of the catch element is able to make contact with a sidewall of the recess when the contact moves counter to the plug-in direction, thereby inhibiting a further movement of the contact out of the contact cavity.

12. The electrical plug-in connector as recited in claim 11, wherein an elasticity of the material of the projection is lower than an elasticity of a material of the sidewall of the contact cavity, so that when the contact is pulled out of the contact cavity and the catch element is consequently pressed against this sidewall, the projection creates a depression in the sidewall, so that the depression inhibits a movement of the second section of the catch element in a direction away from the housing of the contact.

13. The electrical plug-in connector as recited in claim 12, wherein the first area of the projection extends from the second section of the catch element obliquely toward the outside, away from the housing, such that the depression in the sidewall of the contact cavity that results therefrom is directed obliquely toward the outside.

* * * * *